United States Patent [19]

Gilbert

[11] Patent Number: 4,513,822

[45] Date of Patent: Apr. 30, 1985

[54] ANCHOR SEAL ASSEMBLY

[75] Inventor: Bruce Gilbert, Huntsville, Tex.

[73] Assignee: Hughes Tool Company, Houston, Tex.

[21] Appl. No.: 502,829

[22] Filed: Jun. 9, 1983

[51] Int. Cl.[3] ..... E21B 23/00

[52] U.S. Cl. ..... 166/382; 166/217

[58] Field of Search ..... 166/382, 206, 207, 208, 166/210, 216, 217

[56] References Cited

U.S. PATENT DOCUMENTS

| | | | |
|---|---|---|---|
| 1,745,572 | 2/1930 | Gray et al. | 166/217 |
| 3,126,059 | 3/1964 | Fredd | 166/217 |
| 3,528,500 | 9/1970 | Brown | 166/217 |
| 3,863,715 | 2/1975 | Yonker | 166/217 |
| 3,990,510 | 11/1976 | Decuir | 166/217 |
| 4,059,150 | 11/1977 | Manderscheid | 166/217 |
| 4,345,649 | 8/1982 | Baugh et al. | 166/217 |
| 4,391,326 | 7/1983 | Greenlee | 166/217 |

*Primary Examiner*—Stephen J. Novosad
*Assistant Examiner*—Thuy M. Bui
*Attorney, Agent, or Firm*—Robert A. Felsman; Charles D. Gunter, Jr.

[57] ABSTRACT

An anchor seal assembly is shown of the type used to anchor tubing within the bore of a surrounding conduit to provide a seal between the conduit bore and the tubing. A threaded connector circumscribes a portion of the exterior of the tubing. The threaded connector has external threads for matingly engaging a threaded interior surface within the bore of the surrounding conduit. The threaded connector is slidingly received within a recess provided within the exterior surface of the tubing. The tubing recess has a shoulder area at one end thereof for contacting an end of the threaded connector and has a ramp area at the opposite end for contacting the opposite end of the connector. Movement of the tubing in one direction relative to the conduit bore causes the threaded connector to contact the tubing recess shoulder area thereby causing the connector to ratchet into engagement with the threaded interior surface within the bore of the surrounding conduit. Movement of the tubing in the opposite direction relative to the conduit bore causes the threaded connector to contact the tubing recess ramp area forcing the threaded connector radially outwardly into tighter engagement with the conduit threaded interior to further anchor the seal assembly within the conduit.

3 Claims, 6 Drawing Figures

FIG. 4
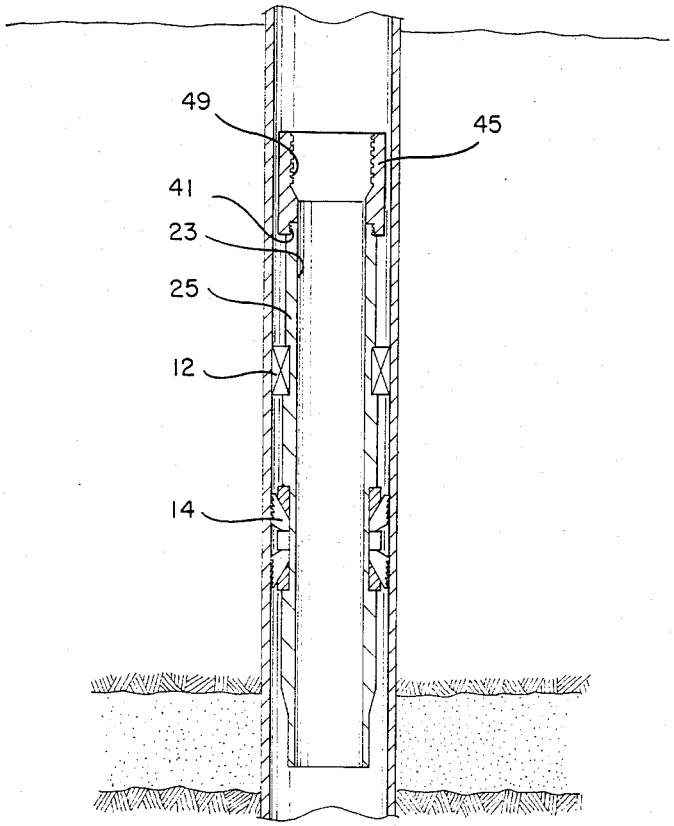
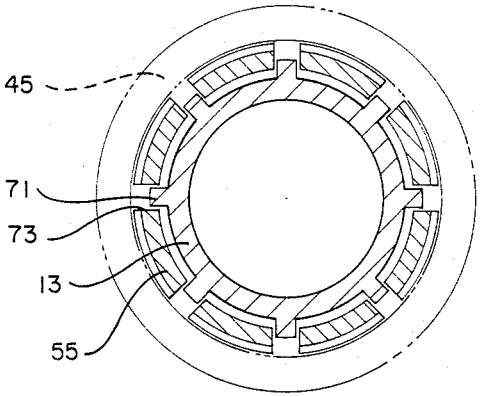
FIG. 3

ANCHOR SEAL ASSEMBLY

BACKGROUND OF THE INVENTION

The present invention relates generally to well devices of the type employed in the completion of oil and gas wells and specifically to an anchor seal assembly of the type used to anchor tubing within the bore of a surrounding well conduit.

In the completion of oil and gas wells, a packer is typically set in a subsurface location within a well casing or other well conduit. The packer is a tubular member having metal locking dogs or slips and annular resilient seal elements which are extended radially to respectively anchor the packer to the casing and to form a pressure tight seal between the packer body and the surrounding well conduit or casing. A production tubing string is then inserted within the bore of the packer body and serves to conduct well effluents which enter the casing below the packer upwardly to the well surface. It is also advantageous to anchor the production tubing within the well packer because of well pressure differentials which can cause a piston-like effect on the production tubing, forcing the tubing upwardly and out of the packer body. It is also advantageous to releasably anchor the tubing within the surrounding packer or conduit. Sometimes an anchor assembly will be set in the surrounding conduit and left indefinitely, perhaps for the life of the well. At other times it will be left only for a short time and will thereafter be removed. A releasable anchor for the tubing which can be set and released with a degree of certainty on the part of the operator at the well head is quite useful. After retrieval, the anchor seal assembly can be subsequently reused.

Previous anchor seal assembly designs have frequently untilized relatively large, heavy components which have necessarily limited the size of the central flow passage provided through the anchoring device. The complicated nature of such devices led to mechanical difficulties or failure of component parts at times. Certain of the prior designs featured multi-part tubing bodies at the point of anchoring engagement with the surrounding packer body which constituted potential leak paths and which also increased the possibility of disengagement of the tubing body parts while rotating the tubing string from the surface to carry out well operations.

SUMMARY OF THE INVENTION

The anchor seal assembly of the invention is used to anchor tubing within the bore of a surrounding conduit such as production tubing within the bore of a set packer body. A threaded connector means circumscribes a portion of the exterior of the tubing and has external threads for matingly engaging a threaded interior surface within the bore of the surrounding packer. The connector means is slidably received within a recess provided within the exterior surface of the production tubing. The tubing recess has a shoulder area at one end thereof for contacting an end of the connector means and has a ramp area at the opposite end thereof for contacting the opposite threaded end of the connector means. Movement of the tubing in one direction relative to the packer bore causes the connector means to contact the tubing recess shoulder area and the threaded end to ratchet into engagement with the packer threaded interior. Movement of the tubing in the opposite direction relative to the packer bore causes the connector means to contact the tubing recess ramp area forcing the threaded end into tighter engagement with the packer threaded interior.

Preferably, the connector means is a collet, having a collet base and downwardly extending collet fingers. The collet fingers have external threads for engaging the threaded interior of the packer bore. The threaded collet is slidingly received within the tubing recess whereby the collet base can contact the tubing recess shoulder area at one extent and the collet fingers can contact the ramp area at the opposite extent of the tubing recess. Movement of the production tubing downwardly with respect to the packer bore causes the collet base to contact the tubing recess shoulder area and the threaded collet fingers to ratchet into engagement with the packer threaded interior. Movement of the production tubing upwardly with respect to the packer bore causes the collet fingers to contact the tubing recess ramp area forcing the threaded fingers radially outwardly into tighter engagement with the packer threaded interior. A seal region circumscribes a portion of the exterior of the tubing below the tubing recess. The seal region is slidingly received within the packer bore to seal the annular space between the tubing exterior and the packer interior bore when the tubing is anchored within the packer.

The collet fingers are preferably provided with left hand buttress threads which are releasable from the packer threaded interior by right hand rotation of the tubing. Left hand rotation of the tubing causes the collet fingers to contact the ramp area of the tubing recess forcing the threaded fingers radially outwardly into tighter engagement with the packer threaded interior. A plurality of cogs are provided in the tubing exterior within the tubing recess area which are received within mating slots provided between the collet fingers when the collet is received within the tubing recess. In this way, torque transmitted to the tubing string is transmitted through the cogs to the collet.

Additional objects, features and advantages will be apparent in the written description which follows.

BRIEF DESCRIPTION OF THE DRAWINGS

FIG. 3 is a cross-sectional view of the anchor seal assembly of FIG. 2 taken along lines III—III.

FIG. 4 is a schematic cross-sectional view of a well packer of the type adapted to be used with the anchor seal assembly of the invention.

DETAILED DESCRIPTION OF THE INVENTION

Figure 1:
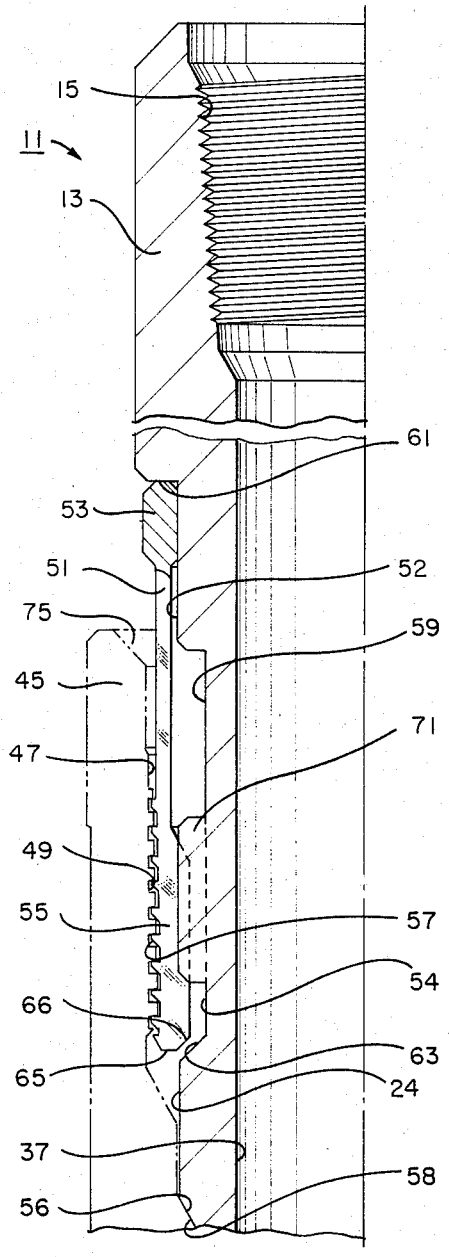
FIG. 1 is a side partial cross-sectional view of the upper end of the anchor seal assembly of the invention in the running-in position.
Figure 1A:
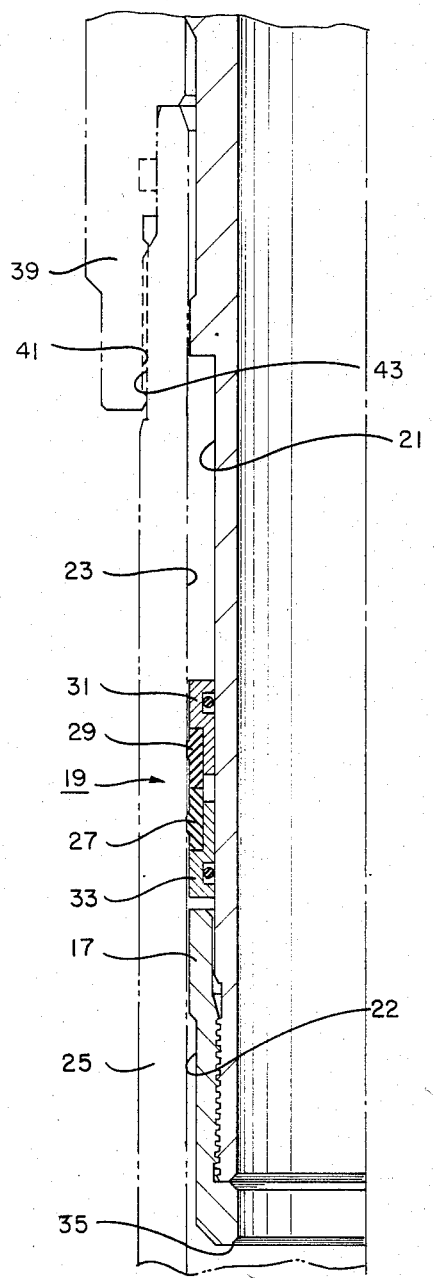
FIG. 1A is a downward continuation of the anchor seal assembly of FIG. 1.
Figure 2:
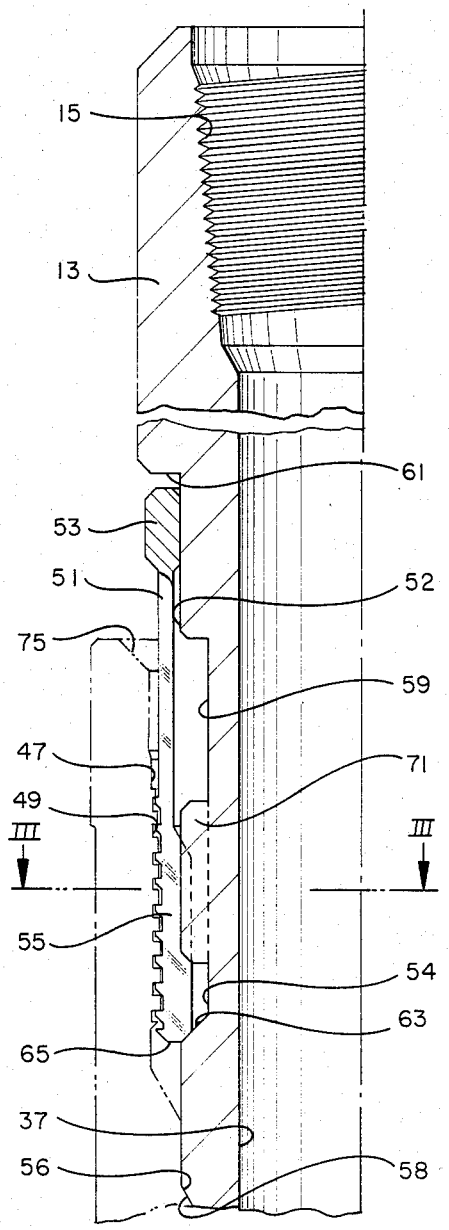
FIG. 2 is a side partial cross-sectional view of the anchor seal assembly of FIG. 1 in the set position.
Figure 2A:
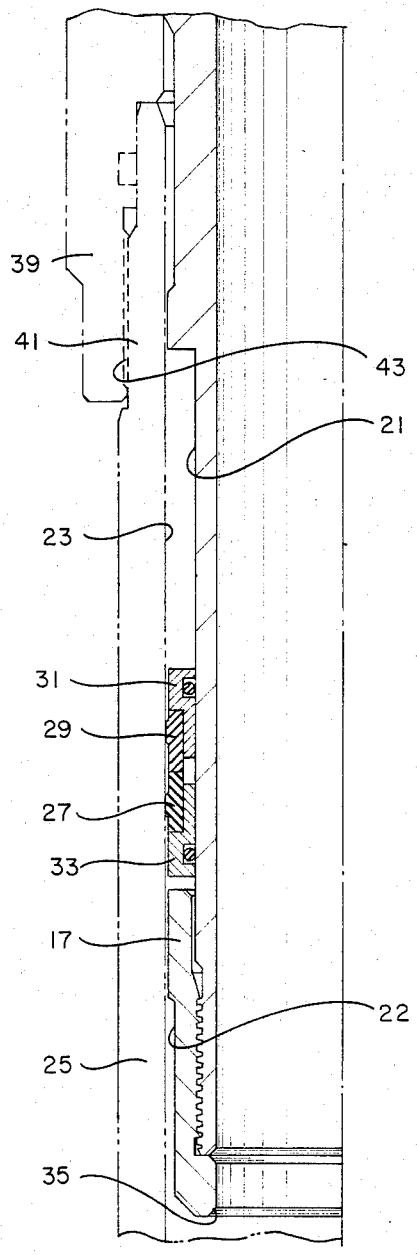
FIG. 2A is a downward continuation of the anchor seal assembly of FIG. 2.

Turning to FIGS. 1 and 1A, there is shown an anchor seal assembly of the invention designated generally as 11. The anchor seal assembly 11 is used to anchor a smaller diameter conduit, such as production tubing within the bore of a surrounding larger diameter conduit such as a set packer body 25 (FIG. 4) to provide a seal between the surrounding conduit bore 23 and the exterior surface 21 of the tubing.

In FIGS. 1 and 1A, a lower sub 13 of a tubing string is shown having an internally threaded connecting end 15 which is adapted to be made up in a string of tubing (not shown) running to the well surface. The tubing sub 13 is a tubular member formed in a single piece which threadedly engages a bottom ring 17. A seal region 19 circumscribes a portion of the exterior surface 21 of the tubing sub 13. As shown in FIG. 1A, the exterior surface 22 of bottom ring 17 and seal region 19 of tubing sub 13 are slidingly received within the bore 23 of a set packer body 25. The packer body 25, shown schematically in FIG. 4, is a conventional packer having expansive elements 12 which is anchored in the surrounding well conduit in the well bore by means of conventional gripping slips 14. The seal region 19 of tubing sub 13 (FIG. 1A) includes elastomeric seal elements 27, 29 which are held in place by upper and lower backup rings 31, 33. The bottom ring 17 of tubing sub 13 also has an open end 35 for receiving well effluents traveling up the packer bore below the seal region 19. As shown in FIG. 1A, the open end 35 of bottom ring 17 communicates by means of an interior bore 37 (FIG. 1) with the connecting end 15 and similarly through the upwardly extending tubing string (not shown) to the well surface.

The packer body 25 also engages an upper sub 39 which has an internally threaded surface 41 for matingly engaging the externally threaded end 43 of the packer body 25. The upper sub 39 is a tubular member having an upper connecting end 45 which has an interior surface 47 which is threaded with square buttress threads 49.

A threaded connector means, in this case collet 51, circumscribes a portion of the exterior surface 21 of the tubing sub 13 which is received within the interior 47 of connecting end 45. The collet 51 (FIG. 1) has a ring-shaped collet base 53 and a plurality of downwardly extending fingers 55 which have external threads 57 for matingly engaging the square buttress threads 49 of the packer upper sub 39.

The collet 51 is slidingly received within a recess 59 provided within the exterior surface 21 of the production tubing sub 13. Collet 51 is assembled on tubing sub 13 by sliding the collet, base 53 first, over the exterior surface 21. The collet base 53 is selectively sized to pass over the region 24 of increased external diameter in the tubing sub 13. The production tubing recess 59 has an upper region 52 and stepped lower region 54. A shoulder area 61 is provided at the upper extent of the recess 59 thereof for contacting the collet base 53. A ramp area 63 formed adjacent the region 24 of increased external diameter is provided at the opposite end of the tubing recess 59 for contacting the lower extent 65 of the collet fingers 55. The collet fingers 55 have a slanting end portion 66 which contacts the mating ramp area 63 of the tubing recess 59.

The tubing exterior surface 21 is provided with at least one cog located in a portion of the stepped lower region 54 of the tubing recess 59. As shown in FIG. 1, cog 71 is a generally rectangular shaped bar having its longitudinal axis aligned with the longitudinal axis of the tubing sub 13. Preferably, a plurality of cogs are evenly spaced about the exterior surface 21 of the tubing sub 13 within the tubing recess 59. Each of the cogs 71 is adapted to be received within a slot 73 (FIG. 3) provided between two of the neighboring collet fingers 55 when the collet is received within the tubing recess 59 whereby torque transmitted to the tubing sub 13 is transmitted through the cogs 71 to the collet 51.

The operation of the anchor seal assembly of the invention will now be described. In the method of anchoring a string of tubing within the bore of a surrounding conduit or packer to provide a seal between the packer bore and the tubing, the tubing sub 13 is first made up in a tubing string by threadedly connecting end 15 in a tubing string. The tubing string including sub 13 is then stabbed downwardly into the bore 23 of the packer body 25. The collet lower extent 65 passes into the throat opening 75 of the packer sub 39 (FIG. 1) and the collet base 53 is forced into contact with the shoulder area 61 of the tubing recess 59. The depth of the tubing recess 59 on the tubing exterior surface is selected to allow the collet fingers 55 to be forced radially inwardly with respect to the tubing exterior surface 21. In this way,the collet fingers 55 can ratchet into engagement with the packer interior buttress threads 49 when the tubing sub 13 and collet 51 are stabbed into the bore of the packer. A locating shoulder 56 is provided in the upper connecting end 45 of the packer body 25 for contacting a mating shoulder 58 (FIG. 1) in the tubing sub 13 when the tubing sub 13 has been completely inserted.

The collet fingers 55 are provided with left hand threads which are releasable from the packer threaded interior surface 47 by right hand rotation of the tubing sub 13 and tubing string from the surface. Left hand rotation of the tubing sub 13 causes the collet fingers 55 to contact the ramp area 63 of the tubing recess 59, forcing the threaded fingers 55 radially outwardly with respect to the tubing recess 59 into tighter engagement with the packer threaded interior surface 49. Likewise, forces tending to move the tubing sub 13 upwardly with respect to the packer body 25 act through the ramp area 63 on the slanting end portion 66 of the collet fingers 55 forcing the collet threads 57 into tighter engagement with the packer buttress threads 49. Such anchoring engagement of the tubing sub 13, collet 51 and packer sub 39 insures that seal region 19 of the tubing sub 13 continues to seal the annular space between the tubing exterior 21 and the packer interior bore 23. After the tubing sub 13 has been stabbed into ratcheting engagement with the packer body 25, the tubing string can be rotated to the left to force the collet slanting end portion 66 into contact with the ramp area 63 to more tightly engage the threads 49, 57. Upward forces acting on the tubing string from the well bore also serve to more tightly engage the threads 49, 57.

The tubing string can be retrieved to the surface by rotating the tubing string and sub 13 to the right to release the threaded collet fingers 55 from the packer threaded interior 47. The tubing string can then be retrieved by pulling the string upwardly out of the packer bore 23 and to the well surface.

An invention has been provided with significant advantages. The anchor seal assembly of the invention has a novel collet connector means which allows the tubing lower extent to be stabbed into the bore of a set packer by extending the tubing downwardly into the packer bore. Upward forces acting on the tubing cause the collet threaded end to contact a tubing recess ramp area to force the threaded collet end outwardly into tighter engagement with a surrounding threaded interior of the packer. The tubing can be released from the packer and retrieved to the surface by right hand rotation of the tubing string which unthreads the collet finger threads and the interior threaded surface of the packer. The tubing sub which carries the collet connector is formed from a single piece of tubular conduit thereby eliminating potential leak paths that existed in prior designs. The single piece tubing sub which carries the collet connector has no threaded connection which could become disengaged during the tightening installation of the tubing string with the packer.

While the invention has been shown in only one of its forms, it is not thus limited, but is susceptible to various changes and modifications without departing from the spirit thereof.

I claim:

1. A method of anchoring a string of production tubing within the bore of a packer to provide a seal between the packer bore and the production tubing, comprising the steps of:

providing a collet carrying tubing sub formed from a single piece of tubular conduit to eliminate potential leak paths, said tubing sub having an upper internally threaded connecting end for connection within a tubing string extending from the well surface, a collet receiving recess formed within the exterior surface of said tubing sub of lesser relative external diameter than said upper connecting end, and a lower end;

providing a threaded collet for circumscribing a portion of the exterior of said tubing sub, said collet having a collet base and externally threaded collet fingers for matingly engaging a threaded interior surface within said packer bore;

installing said collet on the exterior of said tubing sub by sliding said collet base first over said tubing sub lower end and expanding said collet fingers radially outwardly until said collet fingers are received within said recess, said tubing recess having a shoulder area at one end thereof for contacting said collet base and having a ramp area at the opposite end thereof for contacting said collet fingers, said collet being freely received within said recess prior to engaging said packer bore; and stabbing said tubing string downwardly into said packer bore whereby said collet base contacts said tubing recess shoulder area and said threaded collet fingers ratchet into engagement with said threaded interior surface to anchor said tubing within said packer bore.

2. The method of claim 1, further comprising the steps of:

rotating said tubing string to the left after stabbing said tubing string into said packer bore, whereby said collet fingers contact said tubing recess ramp area thereby forcing said collet fingers radially outwardly into tighter engagement with said packer threaded interior.

3. The method of claim 2, further comprising the steps of:

retrieving said tubing string to the surface by first rotating said tubing string and tubing sub to the right to release said threaded collet fingers from said packer threaded interior and thereafter pulling said tubing string upwardly out of said packer bore and to the well surface.

* * * * *